US008851158B2

(12) United States Patent
Alahyari et al.

(10) Patent No.: US 8,851,158 B2
(45) Date of Patent: Oct. 7, 2014

(54) MULTI-CHAMBER HEAT EXCHANGER HEADER AND METHOD OF MAKING

(75) Inventors: Abbas A. Alahyari, Manchester, CT (US); Brian R. Shea, Windsor Locks, CT (US); George E. Wilmot, East Grandby, CT (US)

(73) Assignee: Hamilton Sundstrand Corporation, Rockford, IL (US)

( * ) Notice: Subject to any disclaimer, the term of this patent is extended or adjusted under 35 U.S.C. 154(b) by 1508 days.

(21) Appl. No.: 12/378,500

(22) Filed: Feb. 17, 2009

(65) Prior Publication Data

US 2010/0206532 A1 Aug. 19, 2010

(51) Int. Cl.
*F28F 9/22* (2006.01)
*F28F 9/02* (2006.01)

(52) U.S. Cl.
CPC ..... *F28F 9/0217* (2013.01); *F28F 2275/04* (2013.01); *F28F 9/028* (2013.01); *F28F 2275/06* (2013.01); *F28F 2255/16* (2013.01); *F28F 2275/14* (2013.01)
USPC ..... 165/174; 165/175

(58) Field of Classification Search
USPC ..... 165/144, 174, 176
See application file for complete search history.

(56) References Cited

U.S. PATENT DOCUMENTS

| | | | | | |
|---|---|---|---|---|---|
| 2,184,657 | A | * | 12/1939 | Young | 165/144 |
| 2,419,575 | A | * | 4/1947 | Byram | 165/158 |
| 3,200,983 | A | * | 8/1965 | Walter | 220/533 |
| 4,386,652 | A | * | 6/1983 | Dragojevic | 165/144 |
| 5,097,900 | A | * | 3/1992 | Yamaguchi | 165/174 |
| 5,123,483 | A | | 6/1992 | Tokutake et al. | |
| 5,174,373 | A | * | 12/1992 | Shinmura | 165/176 |
| 5,329,995 | A | | 7/1994 | Dey et al. | |
| 5,348,081 | A | * | 9/1994 | Halstead et al. | 165/144 |
| 5,573,061 | A | * | 11/1996 | Chiba et al. | 165/176 |
| 5,582,239 | A | * | 12/1996 | Tsunoda et al. | 165/76 |
| 6,772,518 | B2 | | 8/2004 | Demuth et al. | |
| 6,830,100 | B2 | | 12/2004 | Gowan et al. | |
| 2003/0066633 | A1 | * | 4/2003 | Lee et al. | 165/144 |
| 2005/0172664 | A1 | * | 8/2005 | Cho et al. | 62/515 |
| 2005/0247443 | A1 | * | 11/2005 | Kim | 165/176 |
| 2007/0006460 | A1 | | 1/2007 | Kim | |
| 2007/0151714 | A1 | | 7/2007 | Forster et al. | |

FOREIGN PATENT DOCUMENTS

| | | | |
|---|---|---|---|
| DE | 1147957 | B | 5/1963 |
| DE | 4319542 | A1 | 12/1994 |
| DE | 102005005043 | A1 | 8/2006 |
| EP | 0683373 | A1 | 11/1995 |

(Continued)

OTHER PUBLICATIONS

The European Search Report mailed Sep. 12, 2013, for European Application No. 10250038.6.

(Continued)

*Primary Examiner* — Allen Flanigan
(74) *Attorney, Agent, or Firm* — Kinney & Lange, P.A.

(57) ABSTRACT

A multi-chamber heat exchanger header includes a header housing and an insert. The header housing has a first wall and a second wall generally opposite the first wall where the first and second walls define a track. The insert is positioned to engage with the track such that the insert separates the header into first and second manifold chambers. A method for forming a multi-chamber heat exchanger header includes extruding a header housing having first and second manifold chambers and a track, positioning an insert in the header housing to engage with the track, and welding or brazing the insert to the header housing.

12 Claims, 5 Drawing Sheets

(56) References Cited

FOREIGN PATENT DOCUMENTS

| | | | | | |
|---|---|---|---|---|---|
| GB | 2453128 | A | | 4/2009 | |
| JP | 64067592 | A | | 3/1989 | |
| JP | 4292793 | A | | 10/1992 | |
| JP | 04335996 | A | * | 11/1992 | ..... F28F 9/02 |
| JP | 07305990 | A | | 11/1995 | |
| JP | 2006522306 | A | | 9/2006 | |
| JP | 2006308148 | A | | 11/2006 | |
| JP | 2009097838 | A | | 5/2009 | |

OTHER PUBLICATIONS

The Japanese Office Action mailed Oct. 15, 2013 for Japanese Patent Application No. 2009-284630.

* cited by examiner

MULTI-CHAMBER HEAT EXCHANGER HEADER AND METHOD OF MAKING

BACKGROUND

The present invention relates in general to heat exchangers, and more particularly, to a multi-chamber heat exchanger header that offers structural integrity while reducing manufacturing costs and complexity.

Headers used in multi-row mini- or micro-channel heat exchangers impart multiple manufacturing challenges. Heat exchanger headers must be strong enough to withstand the elevated pressures exerted by fluids flowing through the headers during operation. In some configurations, adjacent headers must also be in fluid communication with one another. Typically, heat exchanger headers are formed singly (e.g., one header for each row of tubes or channels) and are made from roll-formed, welded tubing or are formed by extrusion.

When multi-panel (e.g., multiple panels or slabs of adjacent micro-channels) heat exchangers are used, multiple single headers are connected together. Multiple headers are welded or brazed together at the inlet and outlet of each heat exchanger panel. In configurations where a header needs to be in fluid communication with an adjacent header, holes are first drilled into each header. The headers are then lined up so the holes in each communicate with one another and then the headers are welded or brazed together.

This process presents notable shortcomings. First, hole drilling must be performed on multiple headers in order for the headers to be in fluid communication. Second, the external welding or brazing joints between adjacent headers offer potential for leakage. Third, the headers have a thickness that is twice what is required in the area where they are connected. Because a header is formed singly and all walls of the header must be able to withstand the operating pressures of the working fluid, the header generally has a uniform thickness to ensure that the entire header is structurally sound. In the area where two headers connect (i.e. the area where the holes are drilled), the walls are prohibitively thick because each of the two headers contributes a generally uniform wall thickness.

SUMMARY

One embodiment of the present invention includes a heat exchanger header with a header housing and an insert. The header housing has a first wall and a second wall generally opposite the first wall where the first and second walls define a track. The insert is positioned to engage with the track such that the insert separates the header into first and second manifold chambers.

Another embodiment of the present invention includes a heat exchanger having first and second pluralities of fluid channels and a header. The header has a first manifold chamber fluidly connected to the first plurality of fluid channels, a second manifold chamber fluidly connected to the second plurality of fluid channels, and a separator plate separating the first and second manifold channels.

An additional embodiment includes a method for forming a heat exchanger header. The method includes extruding a header housing having first and second manifold chambers and a track, positioning an insert in the header housing to engage with the track and welding or brazing the insert to the header housing.

DETAILED DESCRIPTION

Figure 1:
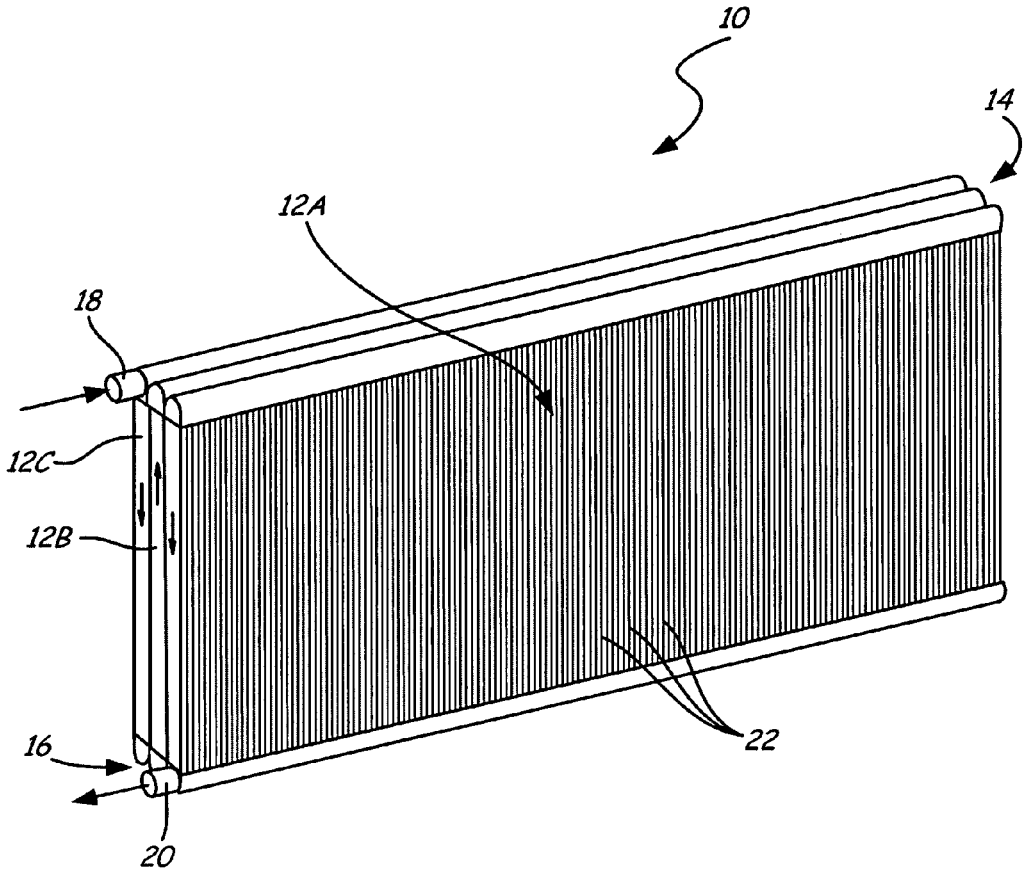
FIG. 1 is a perspective view of a multi-panel heat exchanger.

The present invention provides a new design for heat exchangers and heat exchanger manifolds. FIG. 1 illustrates one embodiment of multi-panel heat exchanger system 10. Multi-panel heat exchanger system 10 includes heat exchange panels 12A, 12B, 12C; multi-chamber headers 14, 16; inlet 18; outlet 20 and heat exchanger channels 22. Multi-panel heat exchanger system 10 has three adjacent panels 12A, 12B and 12C of heat exchanger channels 22. While FIG. 1 shows an embodiment in which panels 12A, 12B and 12C are arranged in a stack, other configurations are possible. Each panel 12 connects to first multi-chamber header 14 and second multi-chamber header 16. First header 14 and second header 16 contain multiple chambers. In the embodiment illustrated in FIG. 1, headers 14 and 16 each contain three manifold chambers (illustrated in greater detail in FIG. 2). Multi-panel heat exchanger system 10 also includes inlet 18 and outlet 20. Inlet 18 is in fluid communication with one chamber in first header 14 or second header 16 and outlet 20 is in fluid communication with a second chamber in first header 14 or second header 16. Depending on the configuration of multi-panel heat exchanger system 10 and the direction of fluid flow, inlet 18 and outlet 20 can be on the same header 14, 16 or different headers 14, 16.

In the embodiment illustrated in FIG. 1, a working fluid (e.g., water, coolant, refrigerant, etc.) enters inlet 18 at the first chamber of first header 14. The first chamber of first header 14 is not fluidly connected to the second chamber of first header 14 directly. Thus, working fluid travels from the first chamber of first header 14 through panel 12C to the first chamber of second header 16. The first chamber of second header 16 is in fluid communication with the second chamber of second header 16. The second chamber of second header 16 is not fluidly connected to the third chamber of second header 16 directly. Thus, working fluid travels from the first chamber of second header 16 to the second chamber of second header 16 and then from the second chamber through panel 12B to the second chamber of first header 14. The second chamber of first header 14 is in fluid communication with the third chamber of first header 14 (but is not fluidly connected to the first chamber of first header 14 directly). Thus, working fluid travels from the second chamber of first header 14 to the third chamber of first header 14 and then from the third chamber through panel 12A to the third chamber of second header 16. The third chamber of second header 16 is not fluidly connected to the second chamber of second header 16 directly. Thus, working fluid exits multi-panel heat exchanger system 10 at outlet 20 from the third chamber of second header 16.

Figure 2:
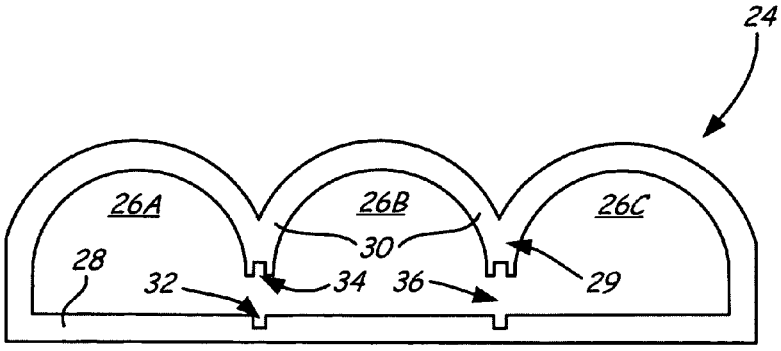
FIG. 2 is a cross section view of one embodiment of a multi-row heat exchanger header housing.

A multi-chamber header reduces the design and manufacturing complexity of multi-panel heat exchanger system 10 while providing sound structural support. Multi-chamber headers 14 and 16 include header housing 24 and insert 38. FIG. 2 illustrates a cross section view of one embodiment of header housing 24. Header housing 24 defines three manifold chambers 26A, 26B and 26C and includes walls 28 and 30 and grooves 32 and 34. While header housing 24 in FIG. 2 defines three chambers 26, other embodiments of header housing 24 can define any number of chambers greater than or equal to two. Chambers 26 are fluidly connected to each other within header housing 24.

Header housing 24 includes walls 28 and 30. Walls 28 and 30 are generally located on opposite sides of header housing 24. In the embodiment illustrated in FIG. 2, wall 28 is straight while wall 30 contains curved wall portions. Longitudinal ribs 29 are formed at the intersection of the curved wall portions of wall 30. Walls 28 and 30 can serve to define chambers 26 (e.g., the curved portions of wall 30) or they can merely serve to mete out the boundaries of chambers 26. In this embodiment, wall 28 also has a plurality of openings that engage with a plurality of working fluid channels 22 (not shown in FIG. 2).

Walls 28 and 30 contain grooves 32 and 34, respectively. Grooves 32 and 34 are generally positioned opposite one another as shown in FIG. 2 to form a track, slot or guide channel 36. Track 36 holds and guides insert 38 within header housing 24. Track 36 formed by grooves 32 and 34 shown in FIG. 2 is generally perpendicular to wall 28. However, grooves 32 and 34 do not necessarily need to be arranged to form a track, slot or guide channel 36 that is perpendicular to wall 28 or 30. Formed track 36 can be at an incline relative to walls 28 and 30. The positioning of grooves 32 and 34 and track 36 further define chambers 26. For example, grooves 32 and 34 and track 36 in FIG. 2 indicate the intersection of chambers 26B and 26C. While the embodiment illustrated in FIG. 2 uses grooves 32 and 34 to define track 36, other embodiments (described in detail below) can define track 36 using rails, ridges or projections.

Figure 3A:
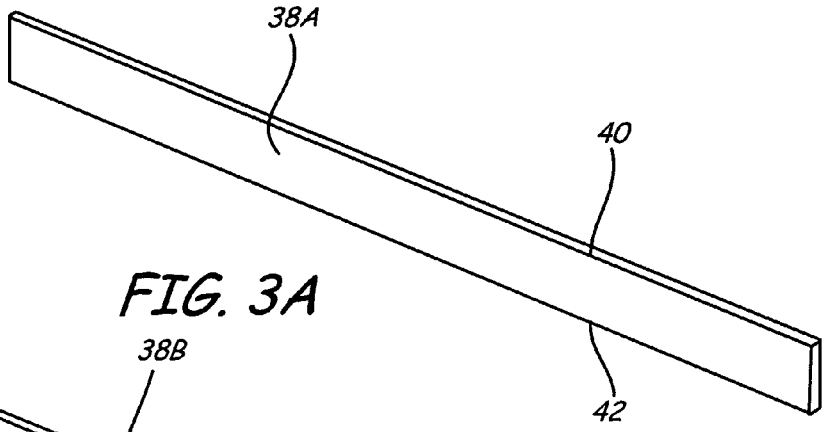
FIG. 3A is a perspective view of one embodiment of a solid insert.
Figure 3B:
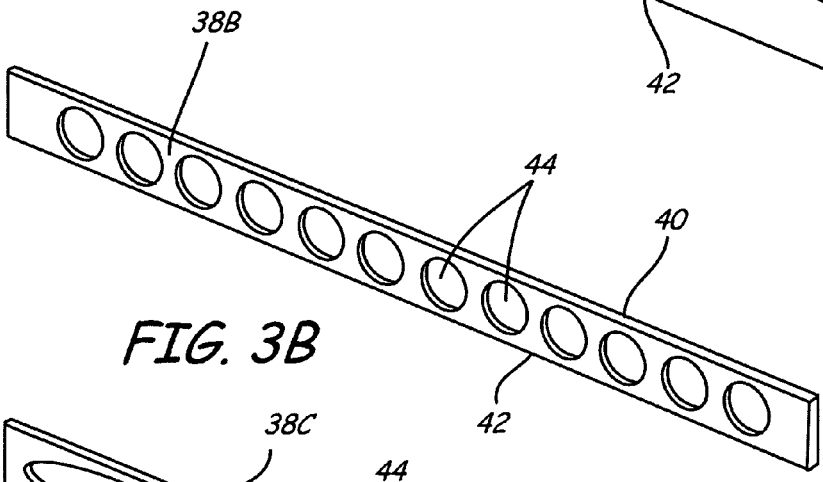
FIG. 3B is a perspective view of one embodiment of an insert with a plurality of passages.
Figure 3C:
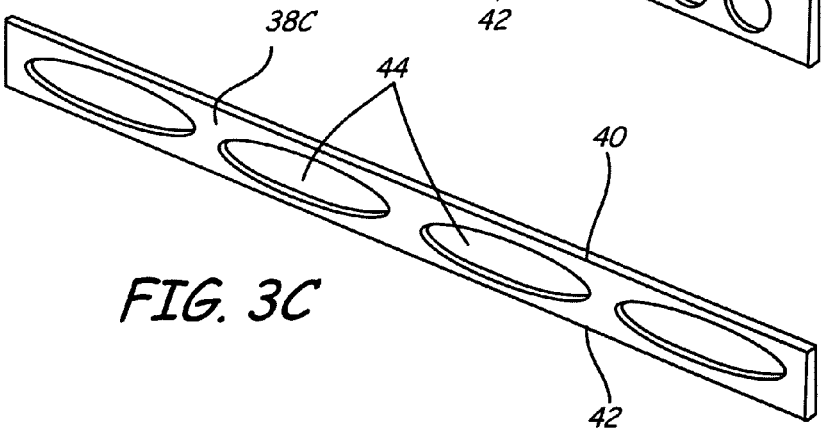
FIG. 3C is a perspective view of another embodiment of an insert with a plurality of passages.
Figure 4:
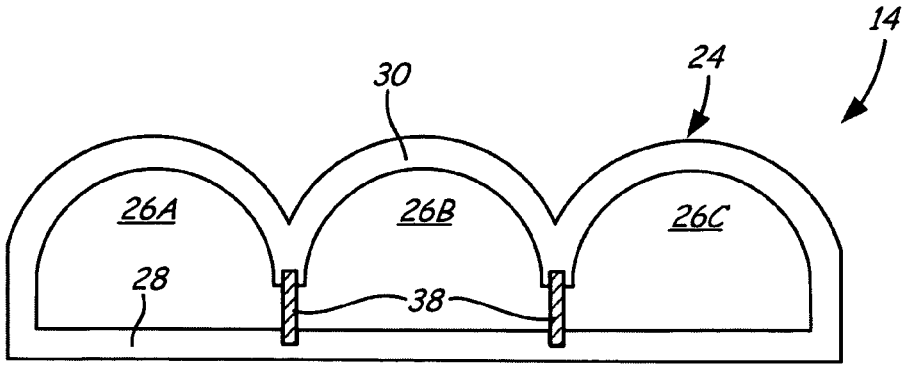
FIG. 4 is a cross section view of the multi-row header of FIG. 2 with inserts in place.

FIGS. 3A and 3B illustrate two different embodiments of insert or separator plate 38. FIG. 3A shows solid insert 38A. FIGS. 3B and 3C show two embodiments of perforated inserts 38B and 38C, respectively. All inserts 38 include first end 40 and second end 42. Insert 38 is positioned within track, slot or guide channel 36 in header housing 24 formed by grooves 32 and 34 as illustrated in FIG. 4. When inserted into header housing 24, first end 40 is positioned within groove 32 and second end 42 is positioned within groove 34. Once inserted, insert 38 can be welded or brazed to header housing 24. Welding or brazing insert 38 to header housing 24 eliminates leakage that could occur between grooves 32, 34 and first and second ends 40, 42. Welding or brazing also provides additional structural support to header housing 24. Insert 38 has a longitudinal length equal to that of header housing 24.

Figure 5:
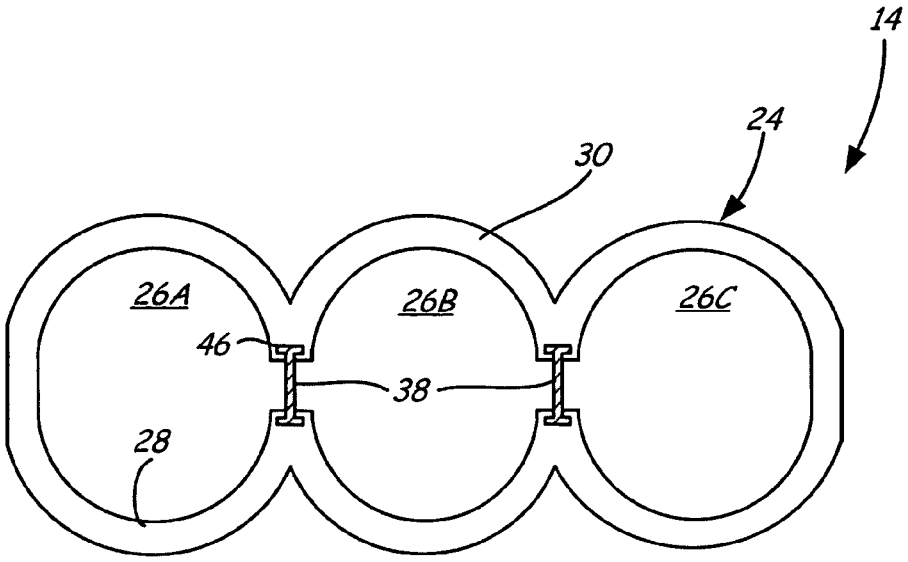
FIG. 5 is a cross section view of one embodiment of a multi-row header with flanged inserts in place.
Figure 8:
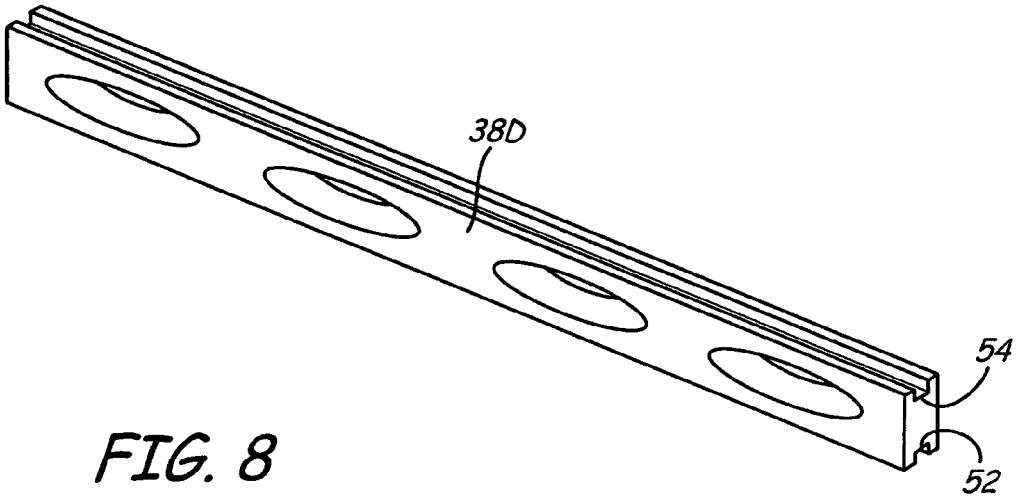
FIG. 8 is a perspective view of one embodiment of a perforated insert compatible with the multi-row header of FIG. 7.

Solid inserts 38A and perforated inserts 38B and 38C are positioned in header housing 24 to produce the desired flow paths of multi-panel heat exchanger system 10. When solid insert 38A is positioned within header housing 24, insert 38A prevents fluid from communicating between manifold chambers 26 adjacent insert 38A. Insert 38A serves as a fluid obstruction, preventing fluid from traveling from one manifold chamber 26 to the other. Perforated inserts 38B and 38C include one or more passages, perforations or orifices 44. When, perforated inserts 38B or 38C are positioned within header housing 24, inserts 38B or 38C allow fluid to communicate between manifold chambers 26 adjacent insert 38B or 38C. Passages 44 can be positioned and arranged along inserts 38B and 38C to provide uniform distribution of working fluid between chambers 26 as shown in FIG. 3B. Insert 38 can have a rectangular cross section (as shown in FIGS. 3A and 3B), a flanged I-shaped cross section (as shown in FIG. 5) or an irregular cross section (as shown in FIG. 8). For optimal fit, the shape of grooves 32 and 34 will match the cross section shape of insert 38 and vice versa.

FIG. 4 illustrates one embodiment of completed header 14. Inserts 38 are situated within the header housing 24 of FIG. 2. Inserts 38 are positioned within track 36 formed by grooves 32 and 34. Inserts 38 along with walls 28 and 30 define chambers 26A, 26B and 26C. The type of insert 38 used determines whether two adjacent chambers 26 are in direct fluid communication. A solid insert 38A prevents direct fluid connection while a perforated insert 38B or 38C allows direct fluid connection.

In addition to affecting fluid flow, inserts 38 also provide structural support for header housing 24 and header 14. In operation, working fluids can be present in header 14 at elevated pressures. These elevated pressures exert force against walls 28 and 30. The applied force pushes walls 28 and 30 away from one another. This can cause problems in a multi-chamber header without inserts. If the pressure and forces applied are too high, the walls can bulge or the structural integrity of the header can be compromised. Welded or brazed inserts 38 provide additional structural support for header housing 24. Once welded or brazed into tracks 36, inserts 38 hold walls 28 and 30 together and prevent them from separating. Inserts 38 prevent walls 28 and 30 from bulging or buckling, thereby increasing the structural strength of header 14. Unlike the conventional headers that are formed singly, drilled and welded together externally, header 14 does not include a header housing 24 that contains prohibitively thick walls. Instead, header 14 is able to offer sound structural integrity by using inserts 38.

Figure 6:
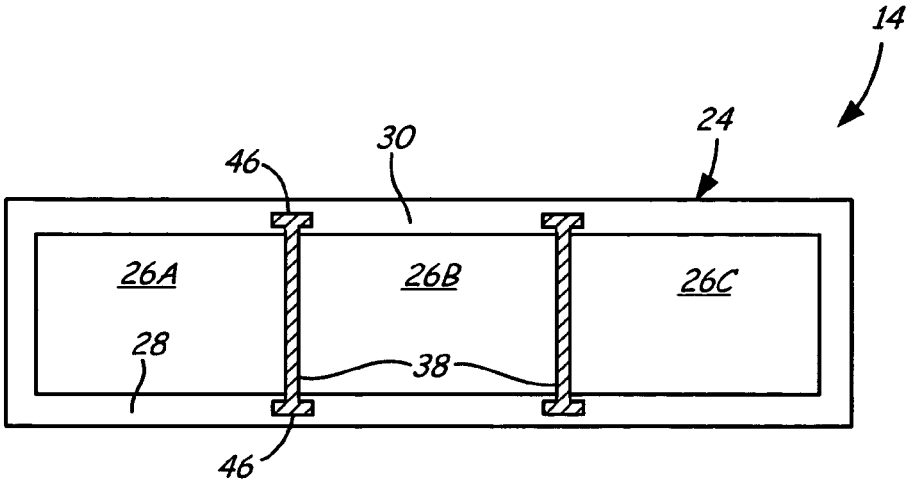
FIG. 6 is a cross section view of another embodiment of a multi-row header with flanged inserts in place.

FIG. 5 illustrates a cross section of another embodiment of header 14. In this embodiment, header 14 includes walls 28 and 30, each with curved portions. Inserts 38 are flanged at each end in the form of a T as shown in the FIG., such that the insert as a whole forms an I-shape. These flanged ends fit into correspondingly T-shaped tracks formed in walls 28 and 30, as shown in FIG. 5. This insert shape provides an even stronger connection between walls 28 and 30. Not only does the welding or brazing of the insert serve to hold walls 28 and 30 together, but flanged ends 46 of insert 38 lock walls 28 and 30 together and provide additional support to prevent walls 28 and 30 from moving apart. FIG. 6 illustrates a cross section of another embodiment of header 14. In this embodiment, header 14 is rectangular. Inserts 38 are flanged and longer relative to inserts 38 of FIGS. 4 and 5.

Figure 7:
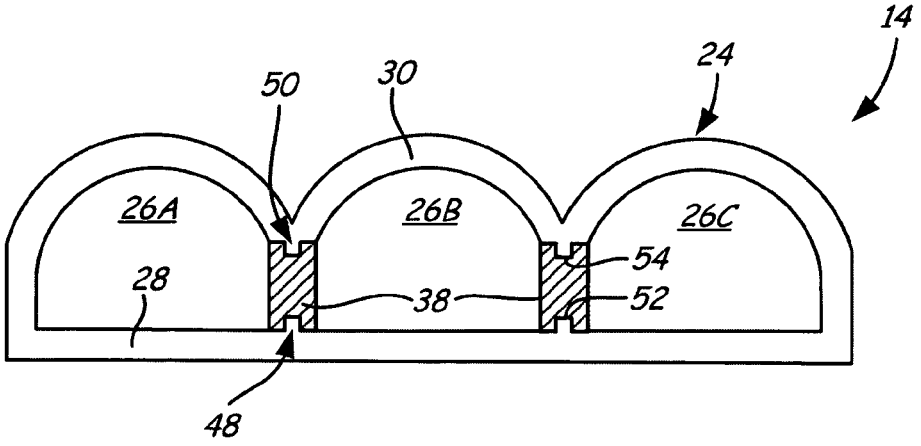
FIG. 7 is a cross section view of a multi-row header with an alternate insert configuration.

FIG. 7 illustrates a cross section of another embodiment of header 14. While headers 14 described in the earlier figures used a track 36 defined by grooves 32 and 34, in this embodiment, track 36 is defined by rails or projections 48 and 50. Rails 48 and 50 are located on wall 28 and wall 30, respectively. Rails 48 and 50 work together to define track 36. Since track 36 is defined by rails instead of grooves, the corresponding insert 38 requires a different shape to engage with track 36. Here insert 38D is wider (as shown in FIG. 8) than inserts 38 of previous figures. Insert 38D includes channels 52 and 54 which receive rails or projections 48 and 50, respectively, to engage with track 36. In this particular embodiment, insert 38 and header housing 24 engage across a larger surface area. This additional surface area engagement allows for additional brazing or welding contact, which can increase the support insert 38 provides to header 14. While FIG. 7 illustrates rectangular projections (wall) and channels (insert), other suitable projection and channel shapes including trapezoidal (dovetail) are possible.

The present invention also provides a method of making multi-chamber header 14 described above. The method includes extruding a header housing having first and second manifold chambers and a track, positioning an insert in the header housing to engage with the track, and welding or brazing the insert to the header housing. Header housing 24 can be extruded from a single piece of material to yield the header housing 24 depicted in FIG. 2 including walls 28 and 30 and grooves 32 and 34. Alternatively, header housing 24 can be extruded without grooves 32 and 34 and grooves 32 and 34 are later machined in walls 28 and 30. Header housing 24 can also be extruded from a single piece of material to yield the header housing 24 depicted in FIG. 7 including walls 28 and 30 and rails 48 and 50. Header housing 24 will contain two or more chambers 26 in direct fluid communication with one another following extrusion. Suitable materials for extrusion include aluminum and other extrudable metals such as copper and titanium. Dimensions of header housing 24 will vary depending on the size of the desired heat exchanger and the working fluid pressures used in the heat exchanger, but chamber widths of about 1.3 cm (0.5 inches) to about 7.6 cm (3 inches) and lengths of about 0.6 m (2 feet) to about 0.9 m (3 feet) and longer are not uncommon. Inserts 38 to be positioned in header housing 24 are made to have the same length as header housing 24 to prevent unwanted leakage between chambers 26.

Once header housing 24 and inserts 38 (to be inserted in header housing 24) have been formed, inserts 38 are positioned within tracks 36 formed by grooves 32 and 34 or rails 48 and 50 in header housing 24. Typically, inserts 38 slide into place within tracks 36. In embodiments where track 36 is defined by grooves, first end 40 of insert 38 occupies groove 32 and second end 42 occupies groove 34. Once positioned, inserts 38 are welded or brazed to header housing 24. The welding or brazing process fills in any gaps between first end 40 and groove 32 or rail 48 and between second end 42 and groove 34 or rail 50.

The present invention provides for a multi-chamber heat exchanger header that is easier and less expensive to manufacture yet provides sound structural support. The header includes a housing capable of being extruded from a single piece of material and one or more inserts positioned within tracks or around rails of the header housing. The inserts offer structural support to the multi-chamber header and establish the flow path of the multi-panel heat exchanger system by allowing or prohibiting flow between the header chambers.

While the invention has been described with reference to exemplary embodiments, it will be understood by those skilled in the art that various changes may be made and equivalents be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A heat exchanger header comprising:

a first wall;

a second wall generally opposite the first wall, wherein the first and second walls define T-shaped tracks, and wherein at least one of the first and second walls includes an aperture configured to communicate with a heat exchange channel; and an I-shaped insert with T-shaped ends generally opposite one another and positioned to engage with the T-shaped tracks and separate the heat exchanger header into first and second manifold chambers.

2. The heat exchanger header of claim 1, wherein the insert is welded or brazed to the first and second walls.

3. The heat exchanger header of claim 1, wherein the insert prevents fluid flow between the first and second manifold chambers.

4. The heat exchanger header of claim 1, wherein the insert further comprises a passage for allowing fluid flow between the first and second manifold chambers.

5. The heat exchanger header of claim 1, wherein the first and second walls are extruded as a single piece.

6. The heat exchanger header of claim 1, wherein the first wall further comprises a curved portion.

7. A heat exchanger header comprising:

a first wall;

a second wall generally opposite the first wall, wherein the first and second walls define T-shaped tracks, wherein the track comprises a first groove in the first wall and a second groove in the second wall, and wherein at least one of the first and second walls includes an aperture configured to communicate with a heat exchange channel; and an I-shaped insert with T-shaped ends positioned to engage with the T-shaped tracks and separate the heat exchanger header into first and second manifold chambers, the insert comprising:

a first T-shaped end positioned within the first groove; and a second T-shaped end positioned within the second groove.

8. The heat exchanger header of claim 1, wherein the first and second walls define a second set of T-shaped tracks, and further comprising:

a second I-shaped insert with T-shaped ends positioned to engage with the second set of T-shaped tracks and separate a third manifold chamber from the second manifold chamber.

9. A heat exchanger comprising:

a first plurality of fluid channels;

a second plurality of fluid channels; and a header comprising:

a first manifold chamber fluidly connected to the first plurality of fluid channels;

a second manifold chamber fluidly connected to the second plurality of fluid channels; and an I-shaped separator plate separating the first and second manifold chambers, the separator plate comprising:

a first T-shaped end;

a second T-shaped end generally opposite the first T-shaped end;

a first wall; and a second wall generally opposite the first wall, wherein the first and second walls define T-shaped tracks, and wherein the separator plate is positioned to engage with the tracks.

10. The heat exchanger of claim 9, wherein the separator plate is welded or brazed to the header.

11. The heat exchanger of claim 9, wherein the separator plate prevents fluid flow between the first and second manifold chambers.

12. The heat exchanger of claim 9, wherein the separator plate further comprises a passage for allowing fluid flow between the first and second manifold chambers.

* * * * *